US007963420B2

(12) United States Patent
Yamanaka

(10) Patent No.: US 7,963,420 B2
(45) Date of Patent: Jun. 21, 2011

(54) CASE FOR A COSMETIC PRODUCT

(75) Inventor: Yasuhiro Yamanaka, Higashi-Osaka (JP)

(73) Assignee: M.F.V. Co., Ltd., Higashi-Osaka-shi (JP)

( * ) Notice: Subject to any disclaimer, the term of this patent is extended or adjusted under 35 U.S.C. 154(b) by 1230 days.

(21) Appl. No.: 11/570,213

(22) PCT Filed: Jul. 12, 2005

(86) PCT No.: PCT/JP2005/012810

§ 371 (c)(1),
(2), (4) Date: Dec. 7, 2006

(87) PCT Pub. No.: WO2006/011355

PCT Pub. Date: Feb. 2, 2006

(65) Prior Publication Data

US 2007/0181575 A1 Aug. 9, 2007

(30) Foreign Application Priority Data

Jul. 26, 2004 (JP) ..... 2004-217532

(51) Int. Cl.

| | |
|---|---|
| ***B65D 43/22*** | (2006.01) |
| ***B65D 43/14*** | (2006.01) |
| ***B65D 8/16*** | (2006.01) |
| *E05F 3/20* | (2006.01) |
| *E05D 11/08* | (2006.01) |

(52) U.S. Cl. ..... 220/830; 220/4.22; 220/844; 16/342; 16/54

(58) Field of Classification Search ..... 220/830, 220/4.27, 4.22, 844; 16/256, 50, 54, 289
See application file for complete search history.

(56) References Cited

U.S. PATENT DOCUMENTS

| | | | | |
|---|---|---|---|---|
| 6,857,538 | B2 * | 2/2005 | Lin | 220/830 |
| 2005/0034269 | A1 * | 2/2005 | Jinbo | 16/51 |

FOREIGN PATENT DOCUMENTS

| | | | |
|---|---|---|---|
| EP | 0 392 345 | A1 | 10/1990 |
| EP | 1 454 558 | A1 | 9/2004 |
| EP | 2 005 855 | A2 | 12/2008 |
| FR | 2 684 962 | A1 | 6/1993 |
| JP | 5-84115 | | 4/1993 |
| JP | 6 46609 | | 6/1994 |
| JP | 6 48517 | | 7/1994 |
| JP | 6-48517 | | 7/1994 |
| JP | 11 56453 | | 3/1999 |
| JP | 2004-267778 | | 9/2004 |
| WO | WO 2005/116381 | A1 | 12/2005 |

* cited by examiner

*Primary Examiner* — Robin Hylton
(74) *Attorney, Agent, or Firm* — Oblon, Spivak, McClelland, Maier & Neustadt, L.L.P.

(57) ABSTRACT

In a case having a cover and a case body connected to each other via a shaft and a shaft inserting portion, a quantity of gel to be used can be reduced while a braking effect of the cover is satisfactorily secured. A shaft is inserted into a shaft inserting portion such that a cover is turned with respect to a case body on the shaft to be opened. An urging mechanism urges the cover in an opening direction. A viscous material is disposed between the shaft and the shaft inserting portion such that the cover is slowly opened with respect to the case body. An engaging projection is disposed at the shaft inserting portion while an engaged recess engageable with the engaging projection is disposed the shaft to enlarge a contact area between the shaft and the shaft inserting portion via the viscous material.

9 Claims, 5 Drawing Sheets

(b)

(a)

CASE FOR A COSMETIC PRODUCT

TECHNICAL FIELD

The present invention relates to a case with a cover, for containing cosmetics or the like therein.

BACKGROUND ART

There has been proposed a case with a cover, for containing cosmetics or the like therein, in which a torsion bar is disposed at a hinge in an opening/closing mechanism, a resilient force is reserved by a twist applied to the torsion bar by a cover closing operation, and the cover is automatically opened by utilizing the release of the resilient force (see Patent Literature 1).

The case of this type adopts a structure in which grease is kept to be charged around the torsion bar, and therefore, since the grease charged around the torsion bar resists against (or interferes with) the release of the twist of the torsion bar when the cover is opened, the cover is slowly opened.

Besides the torsion bar, there has been known a case with a cover that is of the type opened by urging force of an urging member (see Patent Literature 2).

In such a case, a fixed side member and a turn side member are disposed at a case body and the cover, respectively. Blades are disposed at a tip of the fixed side member: in the meantime, gel is charged with the turn side member. Thus, the fixed side member is configured in such a manner as to be inserted into the turn side member. As a consequence, the blades agitate the gel to resist against (or interfere with) the gel when the cover is opened, so that the cover is slowly opened in the same manner.

Patent Literature 1: Japanese Laid-Open Patent Publication No. H5-84115

Patent Literature 2: Japanese Laid-Open Patent Publication No. H6-48517

DISCLOSURE OF INVENTION

Problems to be Solved by the Invention

The opening motion of the cover is braked owing to the resistance between the torsion bar and the grease in the case disclosed in Patent Literature 1. The resistance depends upon an area of the torsion bar in contact with the grease. In view of this, the resistance is small in the case disclosed in Patent Literature 1, in which a wire-like torsion bar is used, and thus, a cover braking effect is not satisfactory.

In the meantime, although the area of the blades in contact with the gel becomes large since the blades are disposed at the tip of the fixed side member in the case disclosed in Patent Literature 2, the gel is charged with the cylindrical turn side member, thereby raising a problem of the necessity of a great quantity of gel. In addition, if force is applied to the cover in order to speedily open the cover, there may occur a danger of breakage of the blades. Moreover, since the turn side member is also reduced in size in a case of a mini size, the area of the blades in contact with the gel becomes small, thereby raising a problem of an insufficient effect of suppressing the opening motion of the cover.

An object of the present invention is to provide "a case with a cover" capable of solving the above-described problems. More particularly, an object of the present invention is to provide a case, in which a quantity of gel to be used can be reduced while enlarging a contact area with a viscous material (equivalent to grease or gel) so as to sufficiently secure the braking effect of the cover by forming an engaging projection at either one of a shaft and a shaft inserting portion while forming an engaged recess engageable with the engaging projection at the other in slowly opening the cover even if the turn side member has a small size.

Means for Solving the Problems

In order to achieve the above-described object, the present invention has taken means, as follows:

Specifically, a case according to the present invention is assumed to include a shaft disposed at either one of a cover and a case body, a shaft inserting portion disposed at the other, the shaft being inserted into the shaft inserting portion in such a manner that the cover is turned with respect to the case body on the shaft, and urging means for urging the cover in an opening direction, a viscous material being charged between the shaft and the shaft inserting portion in such a manner that the cover is slowly opened with respect to the case body.

Here, an engaging projection is disposed at either one of the shaft and the shaft inserting portion while an engaged recess engageable with the engaging projection is disposed at the other in such a manner that a contact area between the shaft and the shaft inserting portion via the viscous material is enlarged.

Such engagement between the engaging projection and the engaged recess enlarge the contact area between the shaft and the shaft inserting portion via the viscous material, so that resistance is applied to the relative turn between the shaft and the shaft inserting portion. As a consequence, it is possible to sufficiently secure a braking effect with respect to the opening motion of the cover with respect to the case body, so that the cover is slowly opened without consuming a large quantity of the viscous material. In addition, it is possible to sufficiently produce the braking effect in the case of a small size of a turn side member, on which it is difficult to produce the braking effect.

An engaged recess may be formed into a ring having the same axis as that of the shaft in such a manner as to allow the shaft to be turned on the axis with respect to the shaft inserting portion.

The engaged recess may be formed at the shaft in such a manner as to be fitted from a tip to a base in the axial direction of the shaft: in contrast, the engaging projection may be formed at the shaft inserting portion in such a manner as to project from a back wall surface of the shaft inserting portion in the axial direction of the shaft.

With another technical means according to the present invention, in the case on the above-described assumption, the shaft may include a joint detachable along an axial direction thereof, so that a shaft length in the shaft inserting portion can be variably adjusted, thus adjusting a contact area between the shaft and the shaft inserting portion via the viscous material.

With this shaft configuration, the contact area between the shaft and the shaft inserting portion can be enlarged via the viscous material, as desired, so that resistance applied to the relative turn between the shaft and the shaft inserting portion can be appropriately increased. As a consequence, it is possible to sufficiently secure a braking effect with respect to the opening motion of the cover with respect to the case body, so that the cover is slowly opened without consuming a large quantity of the viscous material.

In this case, the shaft may include a support rod for holding the joint in a piercing manner, the joint has a rod inserting hole for enabling the support rod to be inserted therethrough, and the axial length of the joint is designed to be shorter than that of the support rod in such a manner that the plurality of joints can be fitted to the support rod.

Incidentally, it is preferable that turn stopping means should be provided between the inner circumferential surface of the rod inserting hole and the outer peripheral surface of the support rod, so as to prevent any relative turn therebetween.

The contact area between the shaft and the shaft inserting portion via the viscous material may be varied (i.e., enlarged) by forming a shaft surface recess such as a groove or a cutout, which defines the shaft of a polygonal cross-sectional shape, at the outer peripheral surface of the shaft.

Moreover, a penetration penetrating between an engaged recess 30 and an outer peripheral surface of a shaft 23 may be formed in such a manner that the viscous material is uniformly charged with the engaged recess 30.

Further technical means according to the present invention is featured in that a lock piece capable of locking against an urging force of an urging member in an opening direction is disposed in a latch fitted to the case body.

In addition, still further technical means according to the present invention is featured in that the case body includes a frame having the shaft or the shaft inserting portion, and a casing fitting around the frame.

Additionally, further technical means according to the present invention is featured in that the cover includes a turn suppressing protrusion which is brought into contact with the case body in such a manner that the opening motion of the cover is temporarily stopped at a predetermined angle, and further, the cover is opened in an opening direction when the cover is pushed in the opening direction.

Effect of the Invention

A quantity of gel to be used can be reduced while enlarging the contact area with the viscous material (equivalent to grease or gel) so as to sufficiently secure the braking effect of the cover by forming the engaging projection at either one of the shaft and the shaft inserting portion while the engaged recess engageable with the engaging projection at the other even if the turn side member has a small size.

DESCRIPTION OF REFERENCE NUMERALS

Figure 1:
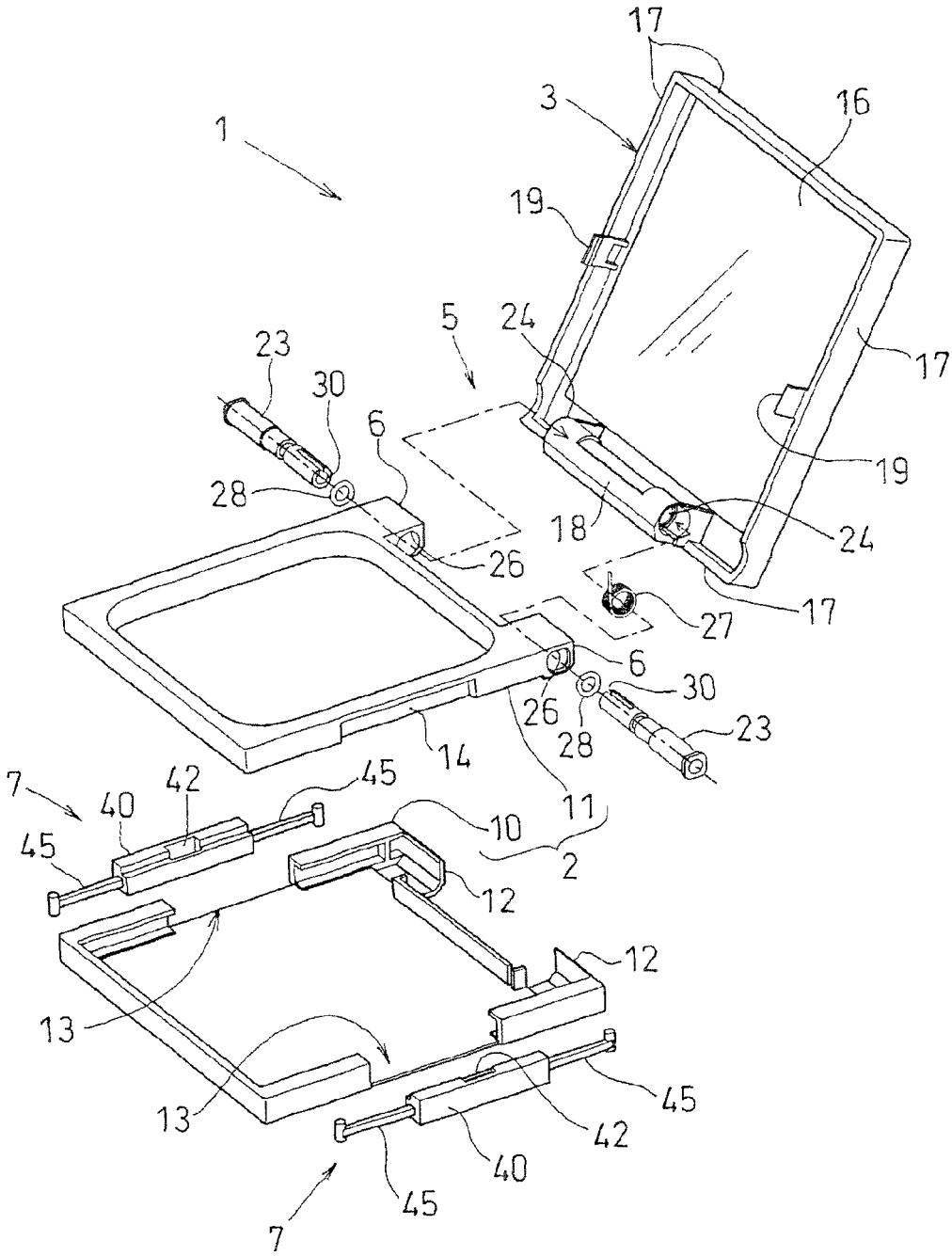
FIG. 1 is an exploded perspective view showing a case in embodiment 1 according to the present invention.

1 case
2 case body
3 cover
10 casing
11 frame
23 shaft
24 shaft inserting portion
27 urging means
30 engaged recess
31 engaging projection
34 turn suppressing protrusion
40 latch
41 lock piece
45 urging member
52 shaft surface recess
55 joint
56 support rod
57 rod inserting hole
58 turn stopping means

BEST MODE FOR CARRYING OUT THE INVENTION

Hereinafter, preferred embodiments according to the present invention will be described in reference to the attached drawings.

FIGS. 1 to 5 show a case 1 in embodiment 1 according the present invention. The case 1 includes a case body 2 and a cover 3 for covering or uncovering the case body 2. The case body 2 and the cover 3 are openably and turnably joined to each other via a hinge mechanism 5, and they can be held by themselves in a plurality of postures, in which the cover 3 is closed over the case body 2, is half opened and is fully opened at predetermined opening angles.

The case body 2 is formed into a thin, flat and square box. At both ends on one side of the case body 2 are spaced a pair of right and left pivots 6 for use in forming the hinge mechanism 5 (hereinafter, a side, on which the pivots 6 are disposed, will be referred to as "a rear end side", both sides of which will be referred to as a right portion and a left portion). On right and left sides of the case body 2 are disposed latch mechanisms 7 for locking and holding a state in which the cover 3 is closed over the case body 2.

The case body 2 has a structure consisting of a casing 10 and a frame 11 fitted inside of the casing 10 without any play. A space defined inside of the frame 11 is adapted to contain therein an article (e.g., a proper article of cosmetics such as foundation cream). In the frame 11 are disposed the right and left pivots 6 projecting backward. In the meantime, in the casing 10 are formed cover pieces 12 for containing the pivots 6 therein and covering outer surfaces except for upper surfaces in a clean style, respectively.

Cutouts 13 for incorporating the latch mechanisms 7 therein, respectively, are formed on the right and left sides of the casing 10: in the meantime, recesses 14 for securing operational spaces for the latch mechanisms 7, respectively, are formed on the right and left sides of the casing 10 in a manner mating with the cutouts 13 formed at the casing 10.

On the other hand, the cover 3 is formed into a thin, flat and square panel, and is adapted to cover the upper surface of the case body 2 in substantially the same outline as that of the case body 2. At the reverse of the cover 3 is attached a mirror 16. Furthermore, peripheral walls 17 are formed on the entire periphery in such a manner as to surround the outer periphery of the mirror 16.

On the rear end side of the cover 3 is disposed a bearing 18 for use in forming the hinge mechanism 5. The bearing 18 is designed to be just fitted between the right and left pivots 6 in the case body 2. Moreover, fitting hooks 19 project toward the right and left latch mechanisms 7 disposed in the case body 2, respectively, on the peripheral walls 17 on the right and left sides out of the peripheral walls 17 of the cover 3.

The hinge mechanism 5 includes shafts 23 inserted into the pivots 6 in the case body 2, respectively, and shaft inserting portions 24 disposed at the bearing 18 in the cover 3.

A through hole 26, into which the shaft 23 can be inserted in a lateral direction without any play, is formed at the pivot 6 disposed in the case body 2 (i.e., the frame 11). The bearing 18 in the cover 3 is inserted between the right and left pivots 6, thereby allowing the through hole 26 formed at the pivot 6 and the shaft inserting portion 24 formed at the bearing 18 to mate with each other. And then, the shafts 23 can be inserted into the shaft inserting portions 24 through the pivots 6 by inserting the-shafts 23 toward the center from left outward of the left pivot 6 and right outward of the right pivot 6.

The shaft inserting portion 24 is a hole having a limitation to a depth (i.e., a bottomed hole), and therefore, the shaft 23 being substantially equal in length to the shaft inserting portion 24 can be inserted into the shaft inserting portion 24 without any play at a portion of the shaft 23 projecting through the pivot 6. Furthermore, in the state in which the shaft 23 is inserted into the shaft inserting portion 24, the relative turn between the shaft 23 and the shaft inserting portion 24 is allowed, so that the shaft inserting portion 24 can be turned on the shaft 23, thereby holding an openable state of the cover 3 with respect to the case body 2.

The hinge mechanism 5 is provided with urging means 27, which urges the cover 3 in an opening direction with respect to the case body 2. The urging means 27 shown in the drawings comprising a coil spring, which is fitted to one of the shafts 23, and its spring legs on both sides are locked to the case body 2 and the cover 3 in the state in which a resilient force is reserved in a spring leg closing direction.

When the shaft 23 is inserted into the shaft inserting portion 24, a viscous material such as grease is charged therebetween. Such a viscous material resists against the relative turn between the shaft 23 and the shaft inserting portion 24 when the shaft inserting portion 24 is turned on the shaft 23, so that the cover 3 is slowly opened from the case body 2 at a suppressed speed by the urging means 27. To the shafts 23 on the right and left sides are fitted seal members 28 made of rubber or a resin relatively near bases (i.e., near opening ends of the shaft inserting portions 24) of portions which are inserted into the shaft inserting portions 24, respectively, thereby preventing the viscous material from leaking outside.

Figure 2:
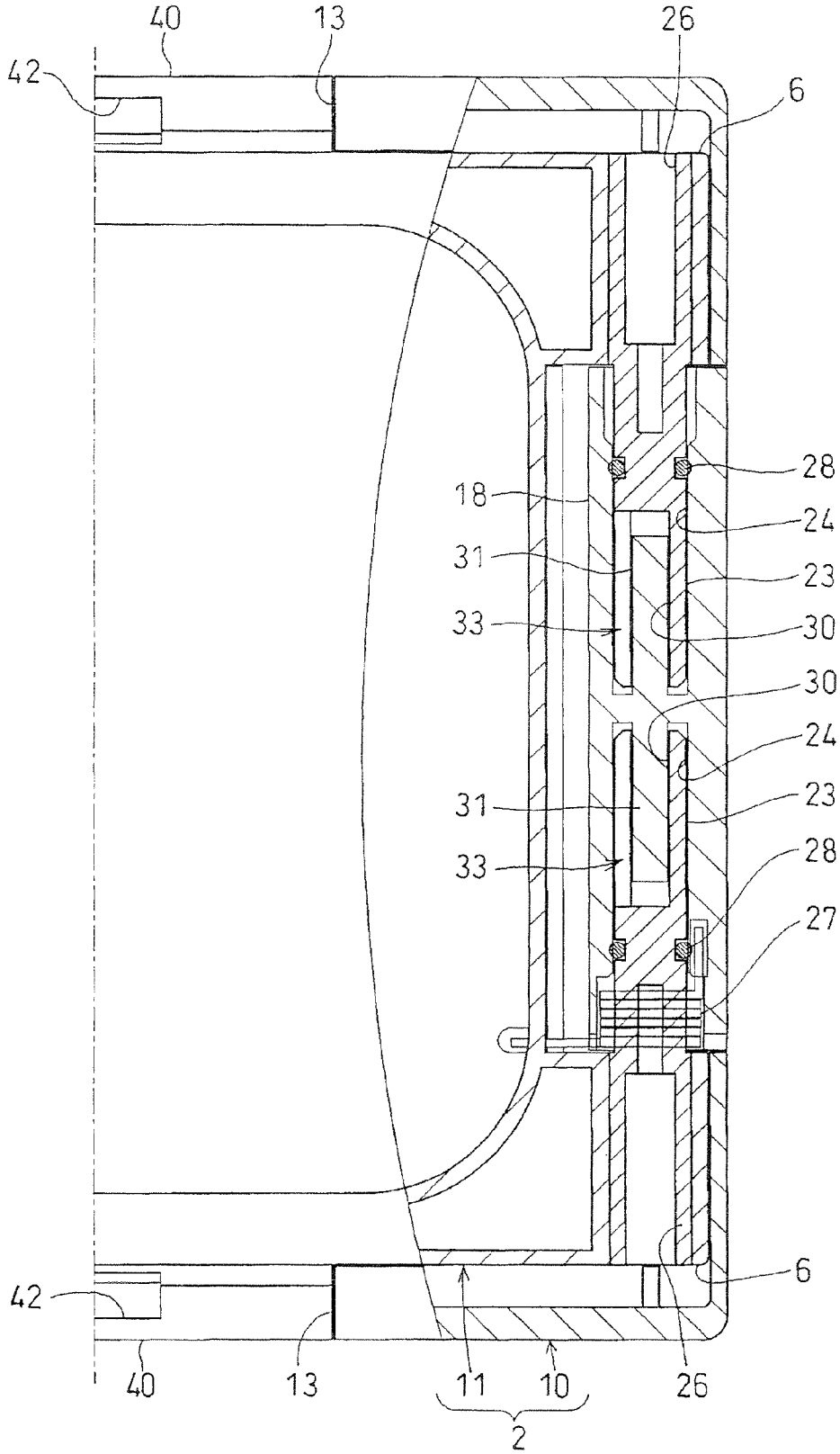
FIG. 2 is a plan cross-sectional view showing a hinge structure in the case in embodiment 1.
Figure 3:
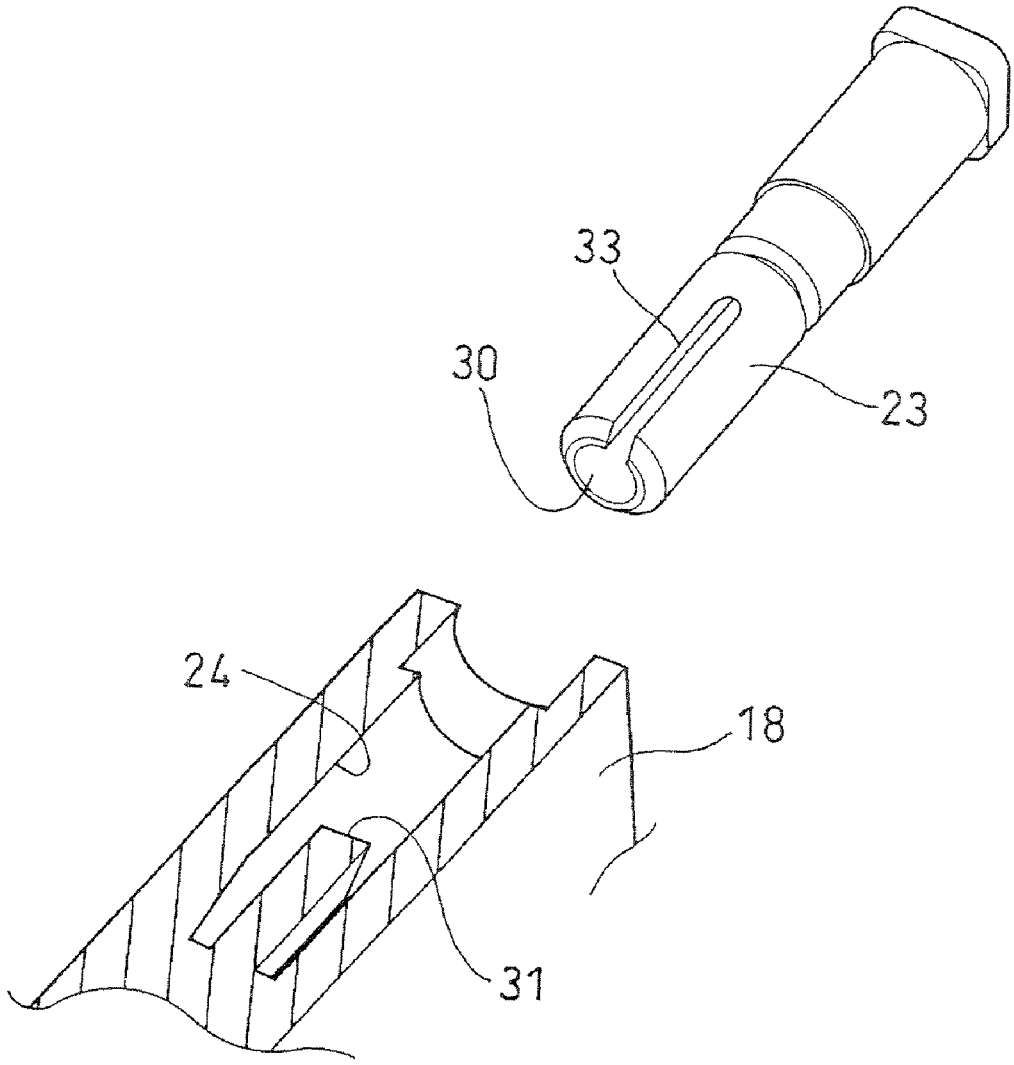
FIG. 3 is an exploded perspective view showing a shaft and a shaft inserting portion used in embodiment 1.

As is clear from FIGS. 2 and 3, an engaged recess 30 is formed at the above-described shaft 23, and further, an engaging projection 31 is formed at the shaft inserting portion 24. When the shaft 23 is inserted into the shaft inserting portion 24, the engaged recess 30 and the engaging projection 31 are designed to engage with each other.

The engaged recess 30 at the shaft 23 is formed by engraving a coaxial hole from a shaft tip toward the base along the axis of the shaft 23. As a consequence, the shaft 23 is formed into a ring-like shape, as viewed in cross section, and exhibits a cylindrical shape. In contrast, the engaging projection 31 at the shaft inserting portion 24 is formed in such a manner as to project from its back wall surface in the axial direction of the shaft 23. The outside shape of the engaging projection 31 is not particularly limited as long as it has a thickness enough to be fitted into the engaged recess 30. Although the engaging projection 31 is formed into a round rod in the drawings, it may be formed into, for example, a square rod, or an uneven rod with serrations at the outer peripheral surface thereof, or a multi-cylindrical shape having a plurality of uneven structures formed at an engaging tip surface.

The above-described viscous material is charged also with an engagement clearance defined by the engagement between the engaged recess 30 and the engaging projection 31, that is, between the inner circumferential surface or back surface of the engaged recess 30 and the outer peripheral surface or tip surface of the engaging projection 31. A contact area between the shaft 23 and the shaft inserting portion 24 via the viscous material can be enlarged by the engagement between the engaged recess 30 and the engaging projection 31.

Consequently, the resistance applied to the relative turn between the shaft 23 and the shaft inserting portion 24 is increased, thereby securing a sufficiently braking effect when the cover 3 is opened with respect to the case body 2. Therefore, the cover 3 can be slowly opened without using the viscous material in a great quantity.

A penetration penetrating between the engaged recess 30 and the outer peripheral surface of the shaft 23 may be formed in such a manner that the viscous material is uniformly charged with the engaged recess 30. For example, a plurality of pores penetrating between the engaged recess 30 and the outer peripheral surface of the shaft 23 may be formed at the shaft 23, to thus serve as penetrations. Otherwise, like in the present preferred embodiment, a slit 33 is formed by cutting the shaft 23 from the tip thereof in the axial direction, to thus serve as a penetration.

The formation of the penetration enables the viscous material to be uniformly charged with the engaged recess 30 when the shaft 23 is inserted into the shaft inserting portion 24, and further, air to be deaerated from the engaged recess 30. Moreover, the slit 33 favorably functions as a clearance when the shaft 23 is inserted into the shaft inserting portion 24 or when the shaft 23 and the shaft inserting portion 24 are turned relatively to each other.

Figure 4:
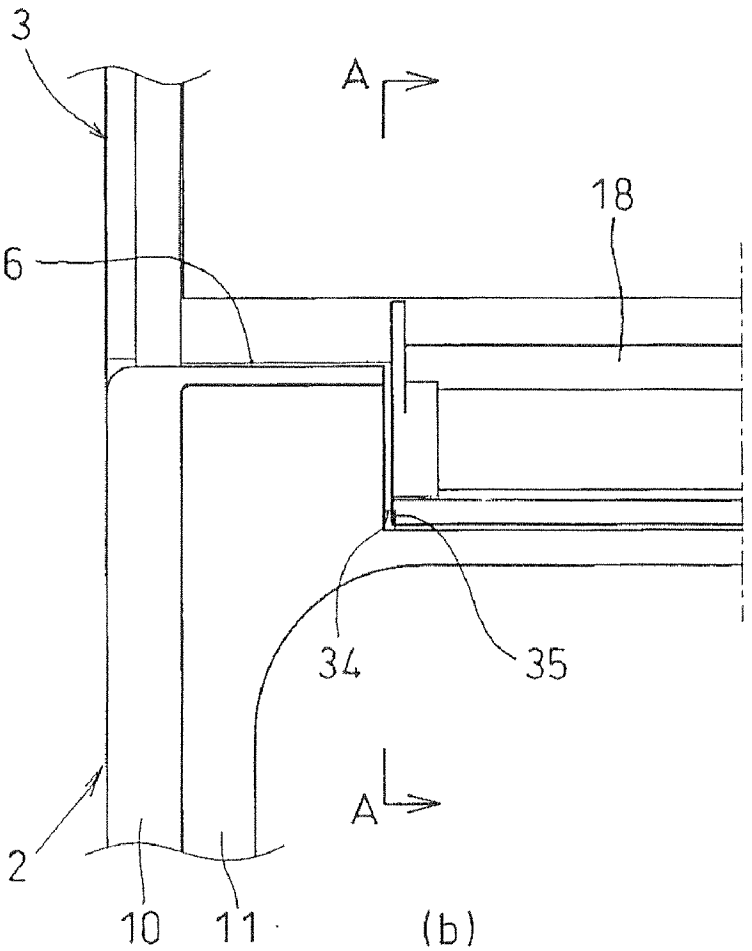
FIGS. 4(*a*) and 4(*b*) show the hinge structure in the case in embodiment 1, wherein FIG. 4(*b*) is a plan view and FIG. 4(*a*) is a cross-sectional view taken along a line A-A of FIG. 4(*b*).
Figure 4:
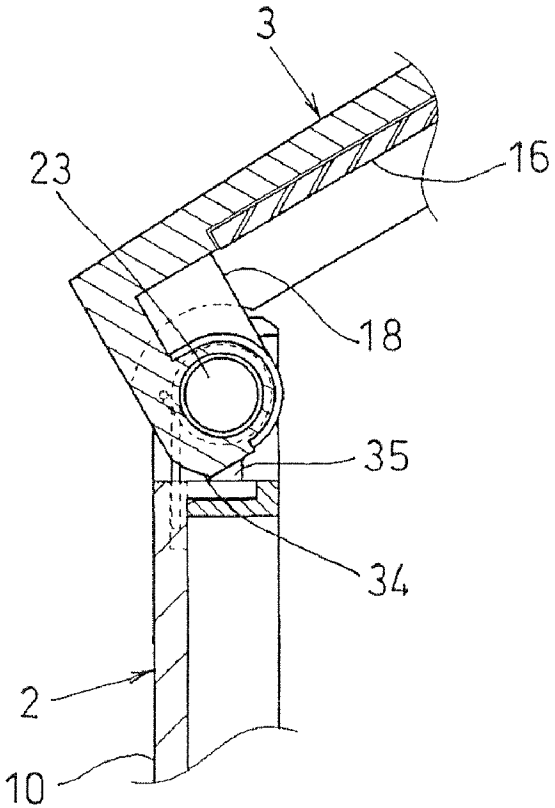

As shown in FIG. 4, a turn suppressing protrusion 34 is formed at the cover 3. The turn suppressing protrusion 34 is formed in such a manner as to provide an acute corner on the shaft 23 at one end of the bearing 18. The corner of the turn suppressing protrusion 34 is oriented such that the turn suppressing protrusion 34 is brought into contact with the case body 2 at an angle, at which the cover 3 is half opened with respect to the case body 2 during the opening motion of the cover 3 with respect to the case body 2.

In the present preferred embodiment, a small triangular stopper piece 35 is disposed at the inside surface of one pivot 6 in the frame 11 of the case body 2, thereby securely achieving a contact with the turn suppressing protrusion 34. Incidentally, the contact between the turn suppressing protrusion 34 and the stopper piece 35 is such slight that the opening motion of the cover 3 is temporarily stopped by a principle factor, that is, the contact between the turn suppressing protrusion 34 and the stopper piece 35 in association with the braking effect by the viscous material when the cover 3 is opened by the urging means 27 (see FIG. 2 or the like). In other words, the turn suppressing protrusion 34 and the stopper piece 35 serve as a turn suppressing mechanism.

If the cover 3 is pushed in the opening direction after the stoppage, the turn suppressing protrusion 34 can relatively readily ride beyond the stopper piece 35, thereby releasing the stopping function caused by the contact between the turn suppressing protrusion 34 and the stopper piece 35. Thereafter, the cover 3 can be further continued to be opened by the urging means 27. In this manner, the cover 3 can be fully opened.

Figure 5:
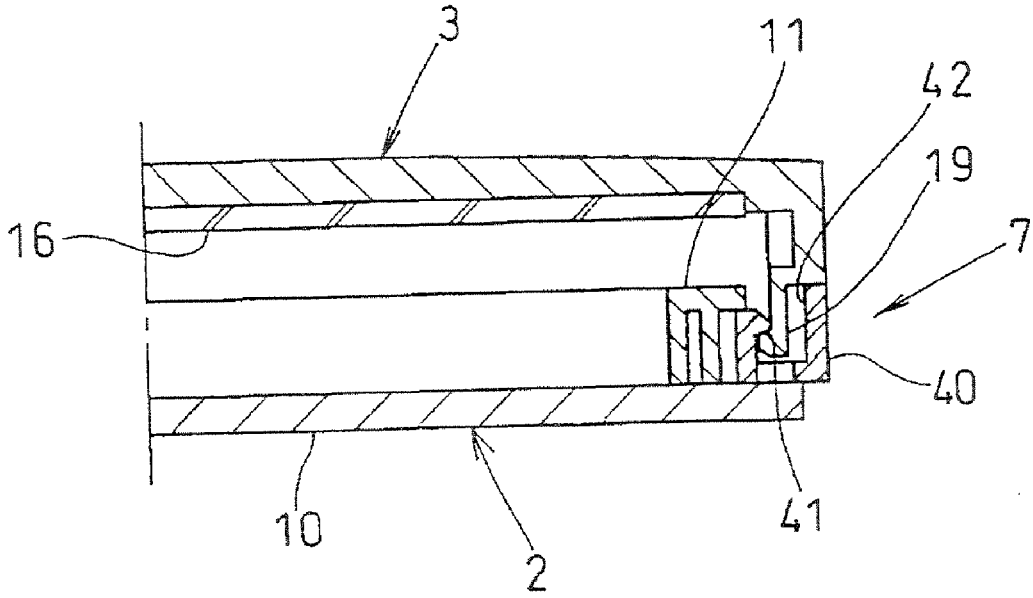
FIG. 5 is an enlarged cross-sectional view showing a cover in a closed state, cut in the vicinity of a latch.

As is clear from FIGS. 1 and 5, latches 40 having a shape just suited to be fitted in the cutouts 13 are contained in the cutouts 13 formed on right and left sides of the casing 10 of the case body 2 in the above-described latch mechanism 7. Furthermore, a lock piece 41 lockable to the fitting hook 19 disposed at the cover 3 is disposed in the latch 40.

In the illustration, the latch 40 is formed into a square rod in horizontal orientation. A hook hole 42 opened in a rectangular manner at a position corresponding to the fitting hook 19 is formed at the upper surface at the center in the longitudinal direction of the latch 40. The lock piece 41 is formed inside of the opening edge of the hook hole 42.

As is clear from FIG. 1, the latch 40 includes urging members 45 extending from both of longitudinal ends thereof in a longitudinal direction. The urging member 45 is made of the same resin material as a material of the latch 40. In the case where the urging member 45 is formed integrally with the latch 40 with the resin material, flexible deformation can be allowed to be restored by utilizing the elasticity of the resin. Incidentally, it is to be understood that the urging member 45 should be formed of a metallic flat spring independently of the latch 40.

When the latch 40, as described above, is contained in the cutout 13 formed at the casing 10, both of the urging members 45 extending from the latch 40 prevent the latch 40 from being detached from the cutout 13. In the case where the case body 2 is constituted by fitting the frame 11 to the casing 10, the urging member 45 is designed to be held between the casing 10 and the frame 11, so that the latch 40 can be moved toward the recess 14 (i.e., an operational space) disposed in the frame 11 on each of the right and left sides with the flexible deformation of the urging member 45 by pushing the latch 40. After this movement, the latch 40 is restored to the original state by a restoring force of the urging member 45 by loosening the pushing force against the latch 40.

When the cover 3 is closed over the case body 2, the fitting hook 19 formed at the cover 3 is inserted into the hook hole 42 formed at the latch 40, to be fitted to the lock piece 41, thereby holding the closed state of the cover 3 over the case body 2. When the right and left latches 40 are pushed opposite to each other in the above-described state, the latches 40 are pushed into the recesses 14 against the urging force of the urging members 45. The operation of the latch 40 at that time can release the engagement between the lock piece 41 and the fitting hook 19. As a consequence, the cover 3 is started to be opened with respect to the case body 2.

In the case 1 having the above-described constitution, the cover 3 is automatically opened at a low speed by pushing the latches 40 disposed on both of the right and left sides of the case body 2 opposite to each other in the state in which the cover 3 is closed over the case body 2. The cover 3 is restrained from being opened in a half opened posture. If the cover 3 is further pushed in the opening direction, as desired by a user, it can be readily turned into a fully opened posture. And then, if the cover 3 is oscillatably pulled in the closing direction, to be finally pressed against the case body 2, the fitting hook 19 formed at the cover 3 is hooked on the lock piece 41 formed at the latch 40. Thereafter, the cover 3 is held in the closed state.

Figure 6:
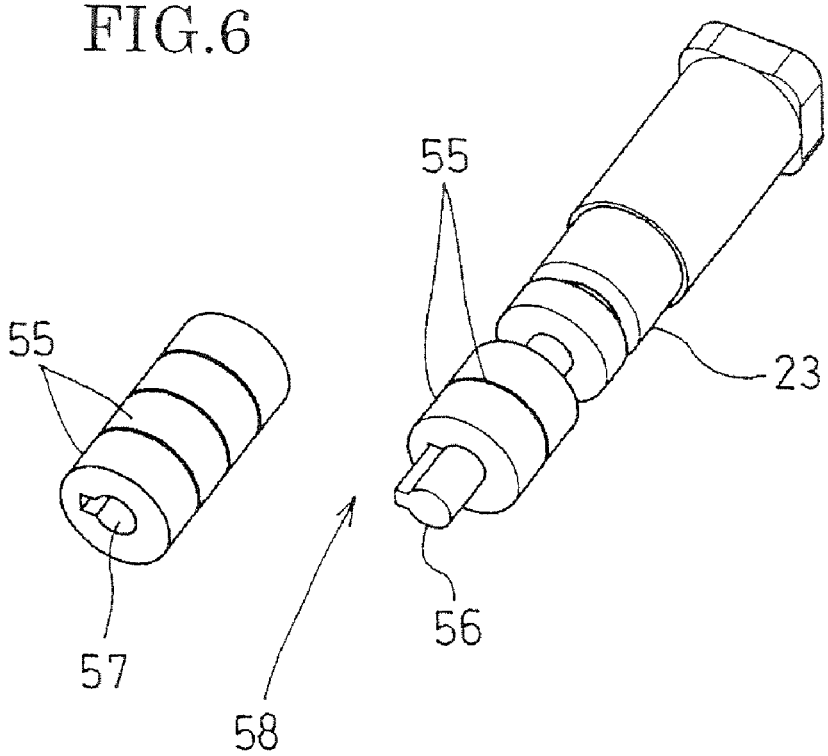
FIG. 6 is a perspective view showing a shaft in embodiment 2.

A joint 55 is detachably attached to a shaft 23 in embodiment 2 according to the present invention in an axial direction, as shown in FIG. 6. Specifically, the shaft 23 includes a support rod 56 for holding the joint 55 in a piercing manner. In the meantime, the joint 55 has a rod inserting hole 57 for enabling the support rod 56 to be inserted therethrough. Moreover, the axial length of the joint 55 is designed to be shorter than that of the support rod 56 in such a manner that the plurality of joints 55 can be fitted to the support rod 56.

The length of the shaft 23 can be variably adjusted inside of a shaft inserting portion 24 according to the number of joints 55 in use, thereby adjusting an increase or a decrease in contact area between the shaft 23 and the shaft inserting portion 24 via a viscous material.

Here, it is preferable that a relative turn should be prevented between the rod inserting hole 57 and the support rod 56 by providing turn stopping means 58 between the inner circumferential surface of the rod inserting hole 57 and the outer peripheral surface of the support rod 56. The turn stopping means 58 shown in the illustration includes a key-like projection projecting at a rod side surface along the axial direction on the side of the support rod 56 and a recessed groove formed at the rod inserting hole 57 in conformity with the key-like projection. Any type of turn stopping means may be adopted as long as it is essential only that the joint 55 should be asymmetrically rotated on the support rod 56.

The present invention is not limited to the above-described embodiments, but it may be appropriately modified or altered in preferred embodiments.

For example, the casing 10 and the frame 11 in the case body 2 may be formed integrally with each other. The relationship between the case body 2 and the cover 3 and the relationship between the shaft 23 and the shaft inserting portion 24 may be relatively combined with each other, and therefore, they may be combined in any way. In addition, the relationship between the shaft 23 and the shaft inserting portion 24 and the relationship between the engaged recess 30 and the engaging projection 31 may be relatively combined with each other, and therefore, they may be combined in any way.

Otherwise, the outer peripheral surface of the shaft 23 may be formed into a specific shape by forming a shaft surface recess 52 at the outer peripheral surface of the shaft 23, thereby enlarging an area via the viscous material. For example, the shaft surface recess 52 may be formed into a groove along an axial direction, a circumferential groove along an axially circumferential direction or a spiral groove extending spirally in an axial direction with respect to an outer peripheral surface of a tip, or may be formed at the outer peripheral surface of a tip thereof into a polygonal column.

Incidentally, the shaft surface recess 52 may be formed not only at the outer peripheral surface of the shaft 23 but also at a tip surface of the shaft 23 or at an inner circumferential surface in the case where there is provided the engaged recess 30, like in embodiment 1.

Alternatively, the volume of the case body 2 may be increased by forming the case body 2 into a deep shape, so that the case body 2 and the cover 3 contain therein a slightly larger article or slightly more articles. Needless to say, the outside shape may be appropriately and arbitrarily selected from a box, a short column and the like, and further, metal, glass, wood and the like in addition to the resin may be partly or entirely used as the material.

Or, a single latch 40 may be disposed at a front portion or a side surface of the case body 2.

As for the turn suppressing mechanism, the turn suppressing protrusion 34 may be sufficiently provided at either one of the case body 2 and the cover 3, wherein the turn suppressing protrusion 34 may be formed into a protruding shape. In addition, the turn suppressing mechanism may include opening angle setting means in such a manner as to temporarily stop the opening motion of the cover 3 at a plurality of opening angles when the opening motion is continued at a greater angle after the opening motion is stopped once. As such opening angle setting means, for example, either one of the case body 2 and the cover 3 may be formed into a shape having a plurality of tops, which abut against the cover 3 or the case body 2 at each of the opening angles, thereby temporarily stopping the opening motion of the cover 3. Otherwise, projections may be formed at either one of the case body 2 and the cover 3, and further, a plurality of recesses may be formed at the cover 3 or the case body 2 in such a manner as to be fitted to the projections at a plurality of opening angles, thereby temporarily stopping the opening motion of the cover 3 owing to the fitting between the projections and the recesses.

Additionally, the urging means 27 need not be disposed at the base of the shaft 23, but it may be disposed at a tip, for example.

INDUSTRIAL APPLICABILITY

The present invention is applicable to the case with the cover, for containing cosmetics or the like therein.

The invention claimed is

1. A case, comprising:

a shaft disposed at either one of a cover or a case body;

a shaft inserting portion substantially equal in length to the shaft and disposed at the other of said cover or case body, said shaft being inserted into the shaft inserting portion such that the cover turns with respect to the case body to open the case; and urging means for urging the cover in an opening direction, a viscous material being disposed between an outer peripheral surface of the shaft and an inner circumferential surface of the shaft inserting portion such that the cover is slowly opened with respect to the case body, wherein an engaging projection is disposed at said shaft inserting portion and an engaged recess engageable with said engaging projection is disposed at said shaft to enlarge a contact area between said shaft and the shaft inserting portion via the viscous material, and said viscous material is disposed between an outer peripheral surface of said engaging projection and an inner circumferential surface of said engaged recess to be turned on the axis with respect to said engaging projection.

2. The case according to claim 1, wherein said engaged recess is formed into a ring having a common axis with the shaft so as to allow the shaft to turn on the axis with respect to the shaft inserting portion.

3. The case according to claim 2, wherein said engaged recess is formed at the shaft so as to be fitted from a tip to a base in an axial direction of the shaft, and said engaging projection is formed at the shaft inserting portion so as to project from a back wall surface of the shaft inserting portion in the axial direction of the shaft.

4. The case according to claim 1, further comprising a penetration device that penetrates between the engaged recess and an outer peripheral surface of the shaft such that the viscous material is uniformly disposed with said engaged recess.

5. The case according to claim 1, wherein a shaft surface includes a recess formed by recessing the outer peripheral surface of said shaft inward in a radial direction such that a contact area between said shaft and the shaft inserting portion via the viscous material varies.

6. The case according to claim 1, wherein a lock piece configured to lock against an urging force of an urging member in an opening direction is disposed in a latch fitted to said case body.

7. The case according to claim 1, wherein said case body includes a frame having said shaft or the shaft inserting portion, and a casing fitting around the frame.

8. The case according to claim 1, wherein said cover includes a turn suppressing protrusion contacting the case body such that an opening motion of the cover is temporarily stopped at a predetermined angle, and the cover is opened in an opening direction when the cover is pushed in the opening direction.

9. A case, comprising:

a shaft disposed at either one of a cover or a case body;

a shaft inserting portion substantially equal in length to the shaft and disposed at the other of said cover or case body, said shaft being inserted into the shaft inserting portion such that the cover turns with respect to the case body to open the case; and urging means for urging the cover in an opening direction, a viscous material being disposed between an outer peripheral surface of the shaft and an inner circumferential surface of the shaft inserting portion such that the cover is slowly opened with respect to the case body, wherein an engaging projection is disposed at said shaft inserting portion and an engaged recess engageable with said engaging projection is disposed at said shaft to enlarge a contact area between said shaft and the shaft inserting portion via the viscous material, and a shaft surface includes a recess formed by recessing the outer peripheral surface of said shaft inward in a radial direction such that a contact area between said shaft and the shaft inserting portion via the viscous material varies.

* * * * *